US006637907B1

(12) United States Patent
Levy

(10) Patent No.: US 6,637,907 B1
(45) Date of Patent: Oct. 28, 2003

(54) LED ILLUMINATION FOR A RESTAURANT MENU

(76) Inventor: Jacqueline Levy, 225 E. 36th St., New York, NY (US) 10016

( * ) Notice: Subject to any disclaimer, the term of this patent is extended or adjusted under 35 U.S.C. 154(b) by 0 days.

(21) Appl. No.: 10/124,017

(22) Filed: Apr. 18, 2002

(51) Int. Cl.[7] ..... A47B 19/00

(52) U.S. Cl. ..... 362/98; 362/156; 362/253; 362/802; 40/452

(58) Field of Search ..... 362/98, 99, 253, 362/155, 156, 802, 276; 40/446, 452

(56) References Cited

U.S. PATENT DOCUMENTS 5,639,156 A * 6/1997 Broxson ..... 362/99
6,205,690 B1 * 3/2001 Heropoulos et al. ..... 40/442

* cited by examiner

*Primary Examiner*—Sandra O'Shea
*Assistant Examiner*—John Anthony Ward
(74) *Attorney, Agent, or Firm*—Myron Amen PC

(57) ABSTRACT

A restaurant menu more easily read in reduced ambient lighting by the added lighting provided by LEDs which are battery operated when a circuit is completed through the hands of a patron in gripping engagement with the edge of the menu, a hand position known to be assumed preparatory to reading.

1 Claim, 2 Drawing Sheets

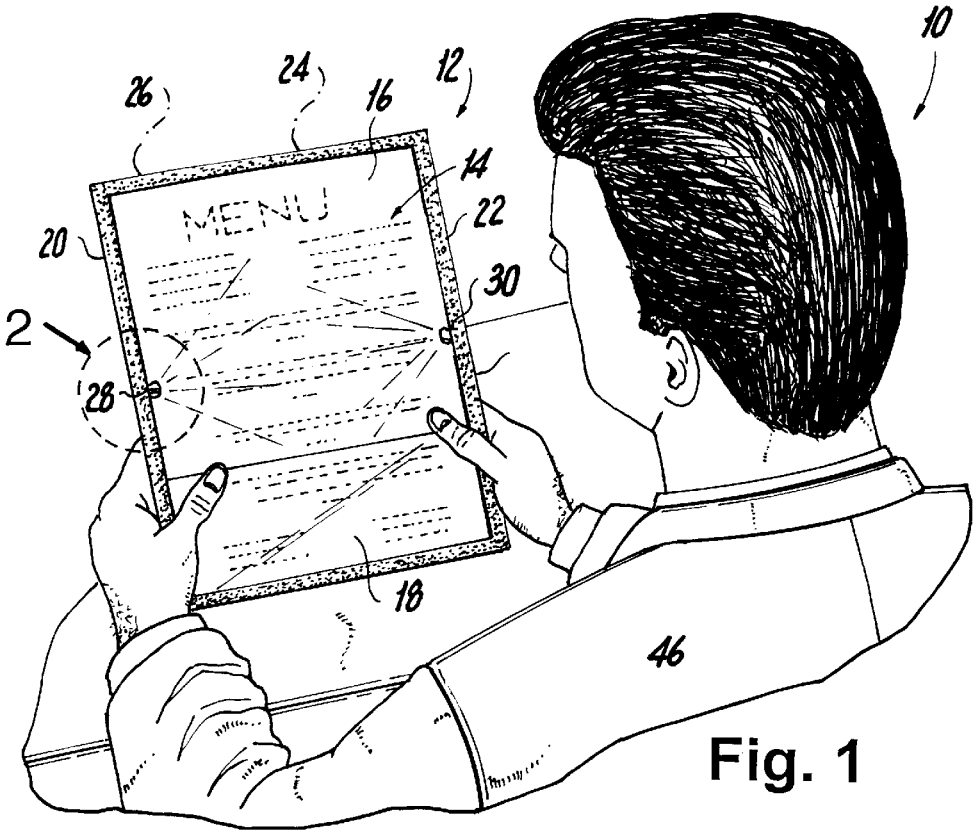
Fig. 1
Fig. 2
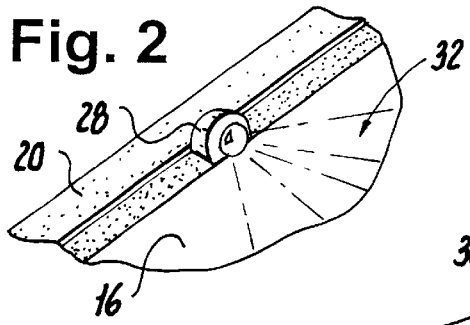
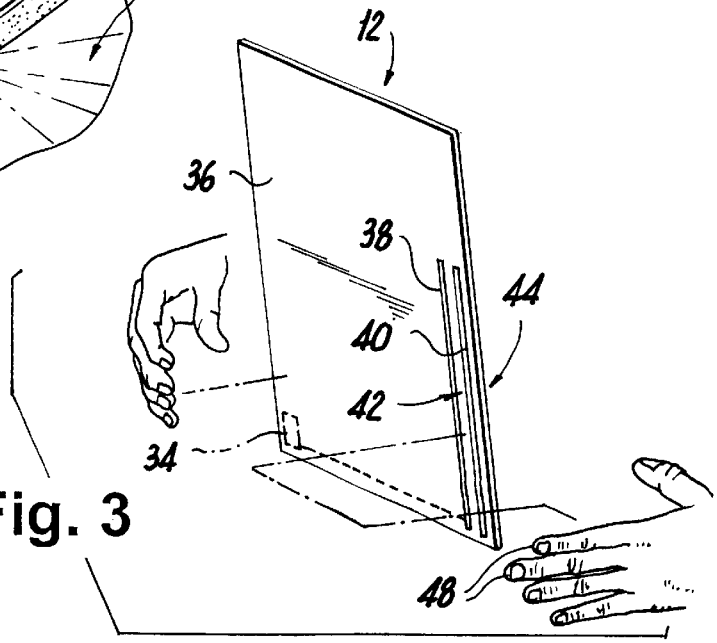
Fig. 3

LED ILLUMINATION FOR A RESTAURANT MENU

The present invention relates generally to the often experienced reading of a menu in a restaurant environment and, more particularly, to raising the light level in which the reading activity is occurring without causing a distraction or otherwise detracting from the enjoyment of the dining experience of other restaurant patrons.

EXAMPLES OF THE PRIOR ART

It is already well known to use a light emitting diode (LED) to provide unobtrusive illumination, as exemplified by the use of LED illumination in U.S. Pat. No. 4,947,989 for "Video Tape Box Advertising Cover Sleeve" and U.S. Pat. No. 4,299,014 for "Animated Device" to mention but a few, but nevertheless, exemplary prior art patents. The LED illumination is further achieved by touch control operation-initiation of the LED in which an open circuit is completed through the body of a user and, thusly functioning as a completed circuit, results in battery powering of the one or plural LEDs.

In the aforesaid and all other known prior patents, the user must follow printed instructions to locations of sites of applying touch control, in order to obtain the LED illumination. This presents a dilemma in that reading the instructions for touch control is as difficult as reading the fare on a menu in the diminished light level of the restaurant.

Broadly, it is an object of the present invention to overcome the foregoing and other shortcomings of the prior art.

More particularly, it is an object to achieve LED illumination at touch control sites without requiring instructional disclosure thereof on a restaurant menu, thereby obtaining the benefit of the unobtrusive but effective light source, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of a patron in a restaurant environment reading a menu enhanced by LED illumination according to the present invention;

FIG. 2 is an isolated view on an enlarged scale of a LED at the location denoted by the arrow 2 in FIG. 1;

FIG. 3 is a perspective view similar to FIG. 1 but illustrating the menu that is being read as seen from the rear;

Figure 4:
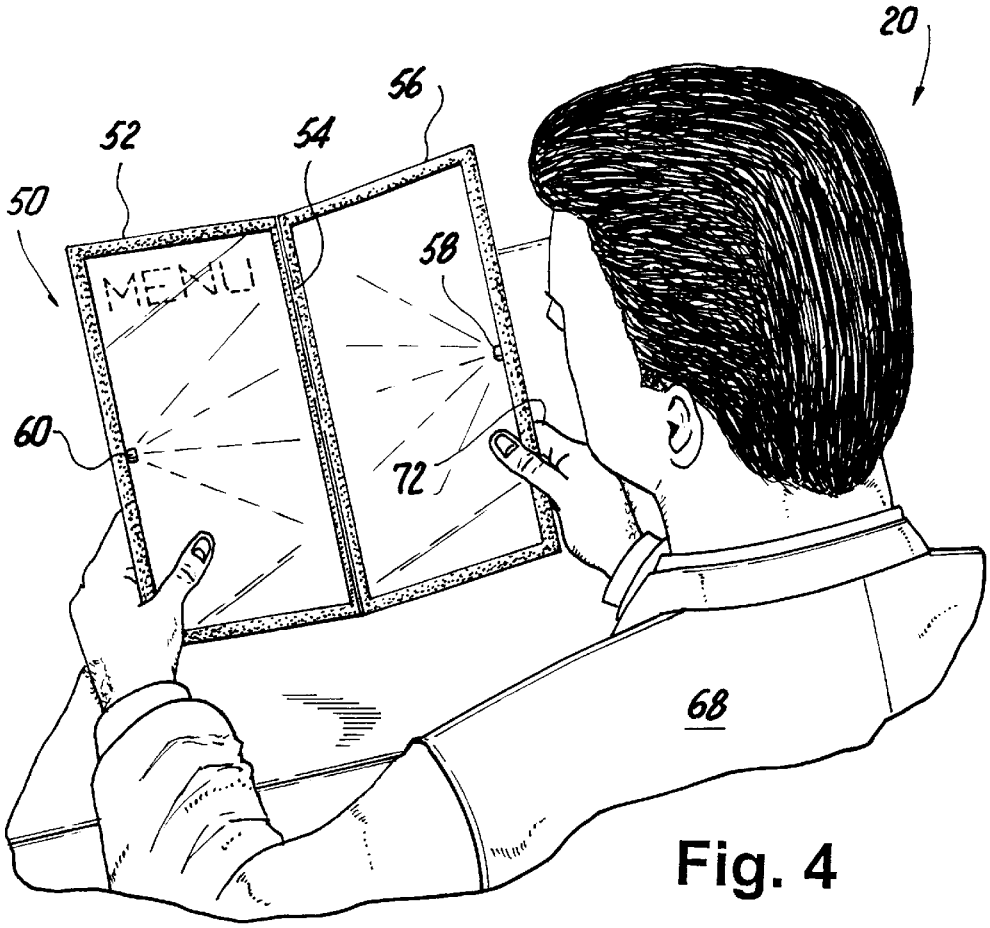
FIG. 4 is another perspective view similar to FIG. 1 but illustrating another embodiment of the menu.

As known from common experience, and as illustrated in FIG. 1, a patron 10 in a restaurant environment preparatory to placing a dinner order will read a menu generally designated 12, usually in a reduced level of ambient light which is thought to provide ambience to the dining experience, the dinner selections, as noted at 14, being imprinted on a paper substrate 16 inserted under a plastic panel 18 appropriately attached, as at opposite edges 20 and 22 to a more rigid cardboard 24 or the like substrate, the latter serving as a front surface 26 of the menu 12.

To raise the ambient light to a higher level more suitable for reading, the menu 12 has at least two Light Emitting Diodes, i.e., LEDs, 28 and 30 each supported at opposite sides of the printed menu sheet 16 and focusing their illumination, as noted at 32, upon the food selections 14. Eschewing, the use of a usual or more commonly used circuit on-off switch, so as to prolong the life of a battery 34 powering the LEDs 28 and 30, so that during an off or non-use operating mode of the menu 12 current is not drained from the battery 34, but only during use, or FIG. 1 operating mode, the menu 12 has imprinted on its rear surface 36 at least two bands or lines 38 and 40 of current-transmitting ink in spaced apart relation, as noted at 42, which constitutes an open circuit 44 for the battery 34. Circuit 44, however, is completed through the body 46 of the user 10 when his/her fingers 48 are in gripping engagement with the menu 12 as occurs when the menu 12 is in its reading position in relation to the user 10, a position which is normally assumed when one is reading, i.e., the position as illustrated in FIG. 1. In the user-facing position of FIG. 1, the fingers 48 are in spanning relation across and in contact with the circuit lines 38 and 40 as illustrated in FIG. 3, and consequently the battery 34 produces illumination 32 from the LEDs 28 and 30. This controlled use of circuit 44 to operate the LEDs 28 and 30 results in prolonged use of the battery 34 before requiring replacement.

Figure 5:
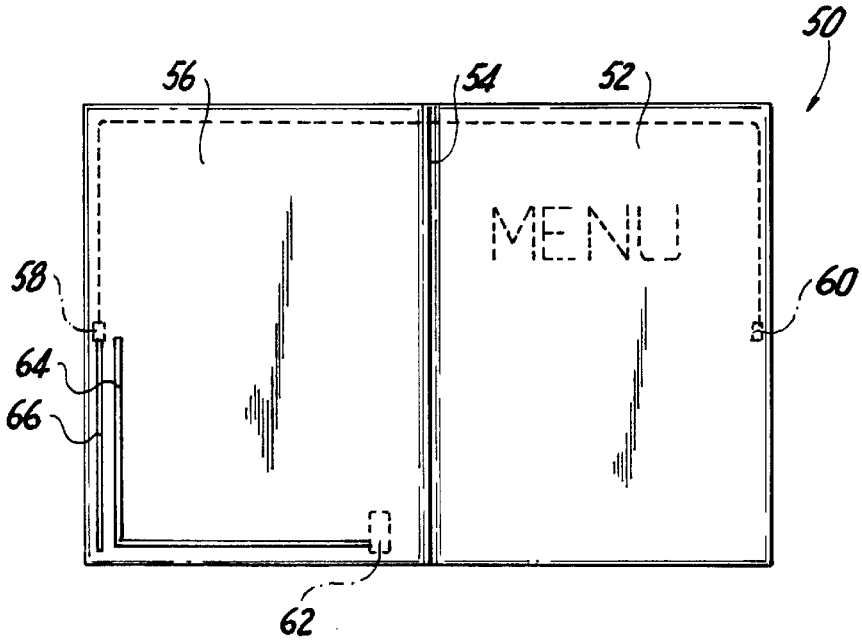
FIG. 5 is a rear view of the menu of FIG. 4.

Reference should now be made to another typical menu embodiment using LEDs to increase the level of light for reading according to the present invention, as illustrated in FIGS. 4 and 5. This menu, generally designated 50, consists of a front cover 52 foldable along a fold line 54 onto a rear cover 56, and via strategically located LEDs 58 and 60 are powered by a battery 62 through open-circuit circuit lines 64. and 66, that as already described are similarly closed through the body 68 of the restaurant patron 70 in the reading condition of FIG. 4 by the fingers 72 extending across the circuit lines 64, 66 provided along the edge of the rear surface 74 of the rear cover 56.

For completeness sale it is noted that the menus 12, 50 can be provided with padded vinyl covers to enhance appearance and feel, and the LEDs 28, 30, 58, 60 and wire leads therefrom adhesively or otherwise appropriately attached at their sites of attachment to the menus and the circuit lines 38, 40, 64, 66. The thickness of the cardboard substrate is a recommended ¼inch which provides a ¼inch depth of a recess for accommodating commercially available watch or chemical-type camera batteries. Lastly, good results have been obtained using current-transmitting ink commercially available from Engelhard Corporation of East Newark, N.J.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A construction for providing illumination to facilitate the reading of a printed menu in a reduced level of ambient light in a restaurant environment, said construction comprising at least one substrate of imprintable construction material of a rectangular shape having a front surface imprinted with food selections and a rear surface, at least one battery-operated LED, an electrical circuit characterized by at least two lines of current-transmitting ink imprinted along opposite side edges on said rear menu surface having a close adjacent position to each other delimiting therebetween a clearance effective to render said electrical circuit in an open electrical mode, and an operative position of said menu preparatory to the reading of the front imprinted surface thereof in facing relation to a restaurant patron orally instructed to read said menu, and in response to said oral instruction an operative position assumed by said restaurant patron characterized by fingers of said restaurant patron in gripped engagement about said opposite side edges and in spanning relation across said clearance and in simultaneous contact with said at least two lines of current-transmitting ink imprinted on said rear menu surface effective to close said electrical circuit into a current conducting mode through the body of said restaurant patron, whereby said reduced light level provided for ambience in said restaurant is raised by LED illumination to an extent reading of said menu without specific instructions to activate said LED-enabling electrical circuit.

* * * * *